US006855943B2

(12) United States Patent
Shields

(10) Patent No.: US 6,855,943 B2
(45) Date of Patent: Feb. 15, 2005

(54) DROPLET TARGET DELIVERY METHOD FOR HIGH PULSE-RATE LASER-PLASMA EXTREME ULTRAVIOLET LIGHT SOURCE

(75) Inventor: Henry Shields, San Pedro, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 237 days.

(21) Appl. No.: 10/157,540

(22) Filed: May 28, 2002

(65) Prior Publication Data

US 2003/0223542 A1 Dec. 4, 2003

(51) Int. Cl.[7] ..... H05H 1/34
(52) U.S. Cl. ..... 250/504 R; 250/493.1; 378/119
(58) Field of Search ..... 250/493.1, 504 R; 378/119

(56) References Cited

U.S. PATENT DOCUMENTS

| | | | | |
|---|---|---|---|---|
| 4,723,262 | A | 2/1988 | Noda et al. | |
| 5,577,092 | A | 11/1996 | Kublak et al. | |
| 6,002,744 | A | 12/1999 | Hertz et al. | |
| 6,507,641 | B1 * | 1/2003 | Kondo et al. | 378/119 |

FOREIGN PATENT DOCUMENTS

WO WO 01 49086 7/2001

OTHER PUBLICATIONS

Rymell, L. et al; "Liquid–jet target laser–plasma sources for EUV and X–ray lithography"; Microelectronic Engineering, Elsevier Publishers BV., Amsterdam, NL, vol. 46, No. 1–4, May 1999.

International Search Report.

Rymell, L., Berglund, M., Hansson, B.A.M. & Hertz, H.M., "X–ray and EUV laser–plasma sources based on cryogenic liquid–jet target", SPIE vol. 3676, Mar. 1999, pps. 421–424.

Gouge, M.J. & Fisher, P.W., "A cryogenic xenon droplet generator for use in a compact laser plasma x–ray source", Rev. Sci. Instrum., vol. 68, No. 5, May 1997, pps. 2158–2162.

(List continued on next page.)

*Primary Examiner*—John R. Lee
*Assistant Examiner*—Paul M. Gurzo

(57) ABSTRACT

A laser-plasma, EUV radiation source (10) that controls the target droplet delivery rate so that successive target droplets (66, 72) are not affected by the ionization of a preceding target droplet. A source nozzle (50) of the source (10) has an orifice (56) of a predetermined size that allows the droplets (54) to be emitted at a rate set by the target materials natural Rayleigh instability break-up frequency as generated by a piezoelectric transducer (58). The rate of the droplet generation is determined by these factors in connection with the pulse frequency of the excitation laser (14) so that buffer droplets (70) are delivered between the target droplets (66, 72). The buffer droplets (70) act to absorb radiation generated from the ionized target droplet (66) so that the next target droplet (72) is not affected.

18 Claims, 1 Drawing Sheet

OTHER PUBLICATIONS

Torres, D., Jin, F., Richardson, M. & DePriest, C., "Characterization of mass–limited ice droplet laser plasmas", OSA Trends in Optics and Photonics, vol. IV, Extreme Ultraviolet Llthography, 1996, pps. 75–79.

Malmquist, L., Rymell, L. & Hertz, H.M., "High–repetition–rate droplet target for laser–plasma EUV generation", OSA Trends in Optics and Photonics, vol. IV, Extreme Ultraviolet Lithography, 1996, pps. 72–74.

Jin, F., Richardson, M.C., Shimkaveg, G.M. and Torres, D., "Charaterization of a Laser Plasma Water Droplet EUV Source", Proceedings of SPEI, vol. 2523, 1995, pps. 81–87.

Rymell, L. and Hertz, H.M., "Droplet Target for Low–debris Laser–plasma Soft X–ray Generation", Optics Communications, vol. 103, 1993, pps. 105–110.

Heinzel, J. and Hertz, C.H., "Ink–jet Printing", Advances in Electronics and Electron Physics, Ed. by P.W. Hawkes, vol. 65, 1985, pps. 91–141.

Tanimoto, M., "Cryogenic Experimental Device for Production of Solid Pellets", Proceedings of 7th Symposium on Fusion Technology, Grenoble, 1972.

* cited by examiner

DROPLET TARGET DELIVERY METHOD FOR HIGH PULSE-RATE LASER-PLASMA EXTREME ULTRAVIOLET LIGHT SOURCE

BACKGROUND OF THE INVENTION

1. Field of the Invention

This invention relates generally to a laser-plasma, extreme ultraviolet light source and, more particularly, to a laser-plasma, extreme ultraviolet light source that provides synchronized laser pulses and a target droplet delivery rate so that buffer droplets are provided between consecutive target droplets.

2. Discussion of the Related Art

Microelectronic integrated circuits are typically patterned on a substrate by a photolithography process, well known to those skilled in the art, where the circuit elements are defined by a light beam propagating through or reflected from a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths and higher frequencies. In other words, the resolution of the photolithography process increases as the wavelength of the light source decreases to allow smaller integrated circuit elements to be defined. The current state of the art for photolithography light sources generate light in the extreme ultraviolet (EUV) or soft x-ray wavelengths (13–14 nm).

U.S. patent application Ser. No. 09/644,589, filed Aug. 23, 2000, entitled "Liquid Sprays as a Target for a Laser-Plasma Extreme Ultraviolet Light Source," and assigned to the assignee of this application, discloses a laser-plasma, EUV radiation source for a photolithography system that employs a liquid as the target material, typically xenon, for generating the laser plasma. A xenon target material provides the desirable EUV wavelengths, and the resulting evaporated xenon gas is chemically inert and is easily pumped out by the source vacuum system. Other liquids and gases, such as krypton and argon, and combinations of liquids and gases, are also available for the laser target material to generate EUV radiation.

The EUV radiation source employs a source nozzle that generates a stream of target droplets in a vacuum environment. The droplet stream is created by allowing a liquid target material (typically xenon) to flow through an orifice (50–100 microns diameter), and perturbing the flow by voltage pulses from an excitation source, such as a piezoelectric transducer, attached to a nozzle delivery tube. Typically, the droplets are produced at a rate defined by the Rayleigh instability break-up frequency (10–100 kHz) of a continuous flow stream. The droplets are emitted from the nozzle where they evaporate and freeze. The size of the orifice is set so that as the droplets freeze and are reduced in size, they are of a size at the ionization region where ionization by a high intensity laser pulse will generate significant EUV radiation, without allowing pieces of frozen xenon to escape ionization, and possibly damage sensitive optical components.

To meet the EUV power and dose control requirements for next generation commercial semiconductors manufactured using EUV photolithography, the laser beam source must be pulsed at a high rate, typically 5–20 kHz. It, therefore, becomes necessary to supply high-density droplet targets having a quick recovery of the droplet stream between laser pulses, such that all laser pulses interact with target droplets under optimum conditions. This requires a droplet generator which produces droplets within 100 microseconds of each laser pulse.

When the laser source is operated at these frequencies for a liquid droplet stream generated at the Rayleigh frequency for an orifice of the desirable size, closely spaced droplets are generated, where the spacing between droplets is approximately nine times the droplet radius. Due to this proximity, a target droplet currently being ionized adversely affects successive droplets in the stream. Thus, the successive droplets are damaged or destroyed prior to being ionized by the laser beam.

One approach for preventing successive target droplets from being effected by ionization of a preceding target droplet would be to have the laser pulse hit each droplet immediately as it emerges from the nozzle orifice. However, this would result in plasma formation very close to the nozzle orifice, providing an excessive heat load and causing plasma-induced erosion of the nozzle orifice.

Another approach would be to energize the piezoelectric transducer at frequencies other than the natural Rayleigh break-up frequency of the target material. In other words, the frequency of the droplet formation can be adjusted away from the Rayleigh frequency, and the droplet spacing can be varied. This will allow some adjustment of the droplet frequency to match the laser pulse frequency. However, operating the transducer at a frequency other than the Rayleigh break-up frequency adversely affects the ability to create a consistent stream of droplets. Because xenon is a gas at room temperature and pressure, the xenon gas is cooled to, for example, −100° C., to liquify it. Drop on demand generators are difficult to control to provide droplets of the right size at the right time because of the surface tension properties of liquid xenon.

Another approach would be to increase the size of the nozzle orifice so that the droplets are generated at the Rayleigh break-up frequency less often. However, this leads to droplets of too large a size for the laser ionization process, possibly causing component damage resulting from unionized frozen xenon.

SUMMARY OF THE INVENTION

In accordance with the teachings of the present invention, a laser-plasma, EUV radiation source is disclosed that controls the target droplet delivery rate so that designated target droplets are not affected by the ionization of preceding droplets. In one embodiment, the source nozzle has an orifice of a predetermined size that allows the droplets of the desired size to be emitted at a rate set by the target material's natural Rayleigh instability break-up frequency, as generated by a piezoelectric transducer. The rate of the droplet generation is determined by these factors in connection with the pulse frequency of the excitation laser so that buffer droplets are delivered between the target droplets. The buffer droplets act to absorb radiation generated from the ionized target droplet so that the next target droplet is not affected.

Additional objects, advantages and features of the present invention will become apparent from the following description and appended claims, taken in conjunction with the accompanying drawings.

DETAILED DISCUSSION OF THE EMBODIMENTS

The following discussion of the embodiments of the invention directed to a nozzle for an EUV radiation source is merely exemplary in nature, and is in no way intended to limit the invention or its applications or uses.

Figure 1:
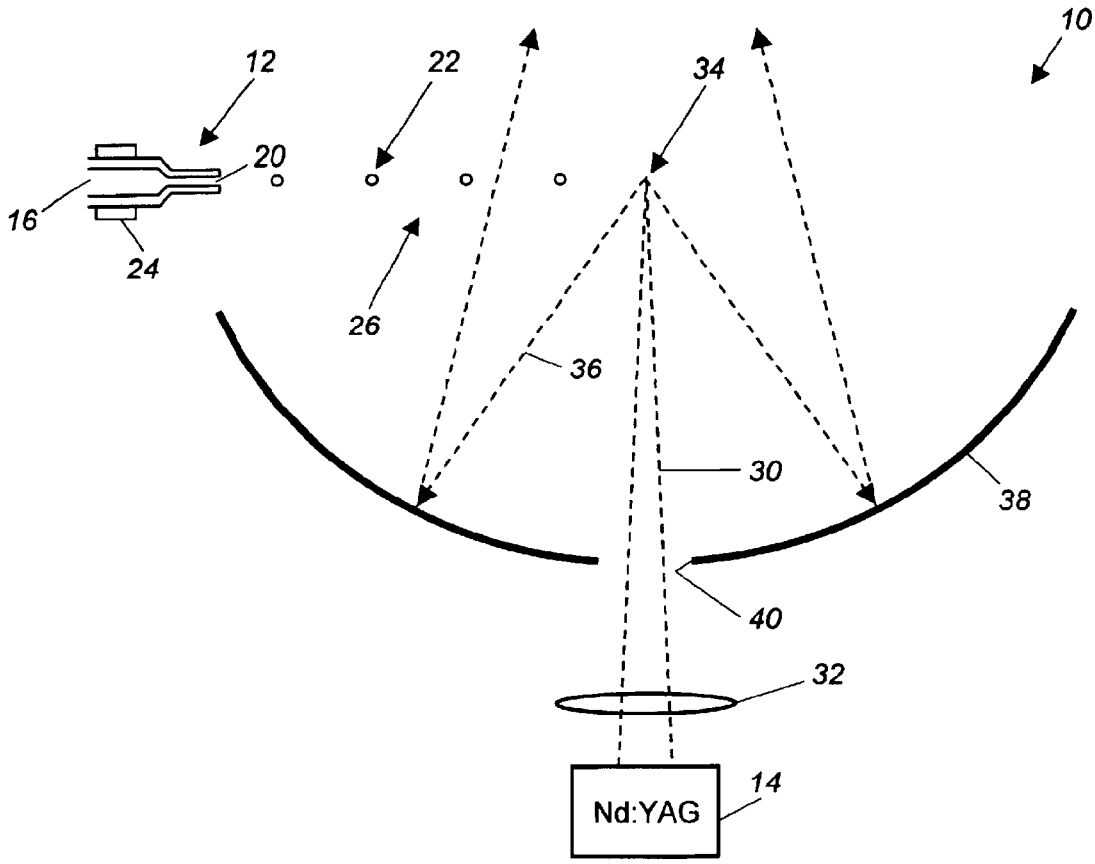
FIG. 1 is a plan view of a laser-plasma, extreme ultraviolet radiation source, according to the invention.

FIG. 1 is a plan view of an EUV radiation source 10 including a nozzle 12 and a laser beam source 14. A liquid 16, such as xenon, flows through the nozzle 12 from a suitable source (not shown). The liquid 16 is forced under pressure through an exit orifice 20 of the nozzle 12 where it is formed into a stream 26 of liquid droplets 22 directed to a target location 34. A piezoelectric transducer 24 positioned on the nozzle 12 perturbs the flow of liquid 16 to generate the droplets 22.

A laser beam 30 from the source 14 is focused by focusing optics 32 onto the droplet 22 at the target location 34, where the source 14 is pulsed relative to the rate of the droplets 22 as they reach the target location 34. The energy in the laser beam 30 ionizes the droplet 22 and generates a plasma that radiates EUV radiation 36. The nozzle 12 is designed so that it will stand up to the heat and rigors of the plasma generation process. The EUV radiation 36 is collected by collector optics 38 and is directed to the circuit (not shown) being patterned. The collector optics 38 can have any suitable shape for the purposes of collecting and directing the radiation 36. In this design, the laser beam 30 propagates through an opening 40 in the collector optics 38. The plasma generation process is performed in a vacuum.

Figure 2:
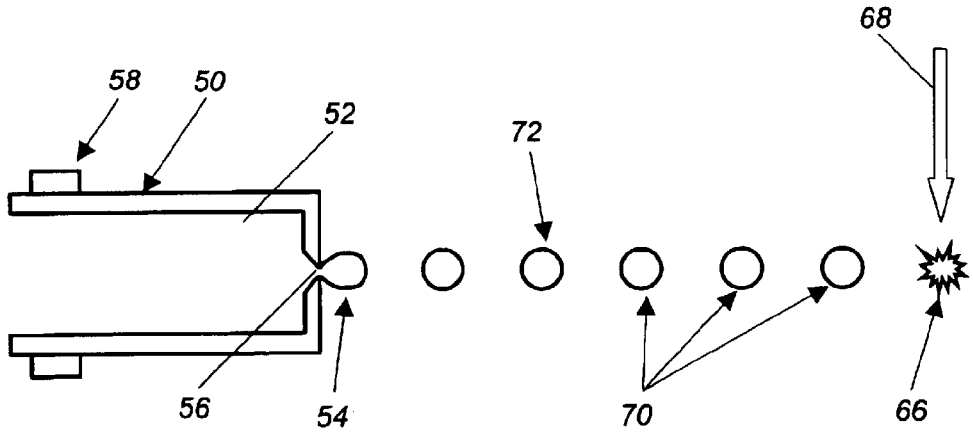
FIG. 2 is a cross-sectional view of a nozzle for a laser-plasma, extreme ultraviolet radiation source providing buffer droplets, according to an embodiment of the present invention.

FIG. 2 is a cross-sectional view of a nozzle 50 suitable to replace the nozzle 12 in the source 10 discussed above, according to the invention. The nozzle 50 receives a liquid target material 52, such as liquid xenon, at one end and emits droplets 54 of the material 52 through a specially configured orifice 56 at an opposite end. According to one embodiment of the present invention, a piezoelectric transducer 58 in contact with the nozzle 50 provides vibrational pulses at a rate associated with the natural Rayleigh break-up frequency of the material 52, as determined by the diameter of the orifice 56. This provides a continuous flow droplet delivery, as opposed to a drop on demand system, where the spacing between the droplets 54 is tightly controlled. In other embodiments, the piezoelectric transducer 58 can be pulsed at frequencies other than the natural Rayleigh break-up frequency to vary the spacing between the droplets 54. Additionally, other excitation devices besides the transducer 58 can be used, as would be appreciated by those skilled in the art.

The stream of droplets 54 is emitted from the nozzle 50 at a rate corresponding to the pulse frequency of the piezoelectric transducer 58, which sets the spacing between the droplets 54. The droplets 54 propagate a predetermined distance to a target area, where a target droplet 66 is ionized by a laser beam 68, such as from the laser source 14. The distance between the nozzle 50 and the target area is selected so that the droplets 54 freeze by evaporation in the vacuum to a desirable size, and is a desired distance away from the nozzle 50 so that the laser ionization process does not damage the nozzle 50.

According to the invention, the pulse rate of the piezoelectric transducer 58, the size of the orifice 56 and the pulse rate of the laser source 14 are all matched so that a predetermined number of buffer droplets 70 are formed between the current target droplet 66 and a next target droplet 72. In this example, there are three buffer droplets 70 between the target droplets 66 and 72, however, this is by way of a non-limiting example for a particular laser pulse frequency.

In one example, EUV light for photolithography requires the laser pulse energy to be about 0.75 J. This energy is absorbed by a 100 micron diameter xenon target droplet, such as the droplet 66, at the target location. The droplet 66 is rapidly ionized to form a plasma which radiates the absorbed energy in the form of kinetic energy of ions, neutral atoms, and particles, and broadband radiation covering the infrared to EUV spectral range. Assuming that the energy is radiated isotropically, the geometric fraction intercepted by the next droplet 70 in the stream is $(r/2R)^2$, where r is the droplet radius and R is the spacing between droplets. For spontaneous Rayleigh break-up into droplets, r is approximately 1.9 times the radius of the nozzle orifice 20, and R is approximately nine times the orifice radius. Thus, $(r/2R)^2=0.011$.

The first droplet 70 after the current target droplet 66 absorbs 1.1% of the initial laser pulse energy, or 8.3 mJ. The mass of a 100 micron diameter liquid xenon sphere is 1.6 micrograms, and the heat of vaporization is 97 J/g or 0.16 mJ. The absorbed energy causes the first droplet 70 after the current target droplet 66 to vaporize, and 8.3–0.16 mJ is radiated from that droplet. Again, assuming isotropic radiation, the second droplet 70 after the current target droplet 66 will capture 1.1% of this energy, corresponding to 0.09 mJ absorbed by the second droplet 70 after the current target droplet 66. This absorbed energy is less than that required to vaporize the droplet (0.16 mJ), so this droplet will suffer minimal disruption. Thus, the second and third droplets 70 act as buffer droplets absorbing the excess plasma energy and protecting subsequent target droplets. The following droplets will be unaffected by the preceding laser pulse, so the droplets stream will be re-established until the next laser pulse hits the next target droplet 72.

In one example, a 15 kHz droplet frequency could be used with a 5 kHz laser pulse rate, providing two buffer droplets 70 between consecutive target droplets. If more buffer droplets 70 are required, the piezoelectric drive pulse rate can be increased to 20 kHz, with a corresponding increase in liquid velocity by providing three buffer droplets 70 between the target droplets 66. This discussion assumes that the droplets 54 are ejected into a vacuum environment. In this case, the droplets 54 will quickly begin to evaporate and their surface temperature will decrease resulting in freezing. This phase change may interfere with the droplet generation, especially if freezing occurs in the orifice. If it is required to maintain the droplets 54 in a liquid state, modifications to the source 50 can be made to provide an intermediate pressure, such as by a carrier gas, to prevent the droplets 54 from freezing, or to control the rate of freezing.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. A laser-plasma extreme ultraviolet (EUV) radiation source comprising:

a nozzle including a source end and an exit end, said exit end including an orifice having a predetermined diameter, said nozzle emitting a stream of droplets of a target material from the orifice;

a target material excitation source providing a pulsed excitation signal to the nozzle; and a laser source providing a pulsed laser beam, wherein the timing of the pulsed excitation source, the diameter of the orifice and the timing of the pulsed laser source are designed relative to each other so that the droplets emitted from the orifice of the nozzle have a predetermined speed and spacing therebetween and so that target droplets within the droplet stream are ionized by the pulses of the laser beam and a predetermined number of buffer droplets are provided between the target droplets that are not directly ionized by the pulsed laser beam, where the buffer droplets absorb radiated plasma energy from ionized target droplets so as to allow subsequent target droplets to be unaffected by preceding target droplet ionization.

2. The source according to claim 1 wherein the number of buffer droplets between the target droplets is selected from the group consisting of one buffer droplet, two buffer droplets and three buffer droplets.

3. The source according to claim 1 wherein the excitation source is pulsed at a frequency that is the natural Rayleigh break-up frequency of the target material for the predetermined diameter of the orifice.

4. The source according to claim 1 wherein the excitation source is a piezoelectric transducer.

5. The source according to claim 1 wherein the orifice has a diameter of between 50–100 microns.

6. The source according to claim 1 wherein the target material is liquid xenon.

7. The source according to claim 1 wherein the laser source has a pulse rate between 5–20 kHz.

8. A laser-plasma extreme ultraviolet (EUV) radiation source comprising:

a nozzle including a source end and an exit end, said exit end including an orifice having a predetermined diameter, said nozzle receiving liquid xenon at its source end and emitting a stream of xenon droplets from the orifice;

a xenon excitation source providing a pulsed excitation signal to the nozzle, said excitation source causing the droplets to be emitted from the orifice, said excitation source being pulsed at a frequency that is the natural Rayleigh break-up frequency of the xenon relative to the size of the orifice; and a laser source providing a pulsed laser beam directed towards a target area, wherein the timing of the xenon excitation source, the diameter of the orifice and the timing of the pulse laser source are designed relative to each other so that the droplets emitted from the orifice of the nozzle have a predetermined speed and spacing therebetween so that target droplets within the droplet stream are ionized by the pulses of the laser beam and a predetermined number of buffer droplets are provided between the target droplets that are not directly ionized by the pulsed laser beam, where the buffer droplets absorb radiated plasma energy from ionized target droplets so as to allow subsequent target droplets to be unaffected by preceding target droplet ionization.

9. The source according to claim 8 wherein the number of buffer droplets between the target droplets is selected from the group consisting of one buffer droplet, two buffer droplets and three buffer droplets.

10. The source according to claim 8 wherein the excitation source is a piezoelectric transducer.

11. The source according to claim 8 wherein the orifice has a diameter of between 50–100 microns.

12. The source according to claim 8 wherein the laser source has a pulse rate between 5–10 kHz.

13. A method of generating target material droplets in a laser-plasma extreme ultraviolet (EUV) radiation source, comprising:

forcing a liquid target material through an orifice of a nozzle;

vibrating the nozzle at a pulsed vibration rate so that the target material exits the orifice as a stream of droplets that is directed towards a target area; and directing a pulsed laser beam towards the target area so that droplets that enter the target area are ionized by the laser beam, wherein the timing of the pulses vibrating the nozzle, the timing of the laser pulses and the diameter of the orifice are selected so that the droplets emitted from the orifice of the nozzle have a predetermined speed and spacing therebetween so that target droplets within the target stream are ionized in the target area by the pulses of the laser beam and a predetermined number of buffer droplets are provided between successive target droplets that are not directly ionized by the pulse beam, where the buffer droplets absorb radiated plasma energy from ionized target droplets so as to allow subsequent target droplets to be unaffected by preceding target droplet ionization.

14. The method according to claim 13 wherein vibrating the nozzle includes vibrating the nozzle at a frequency that is the natural Rayleigh break-up frequency of the target material.

15. The method according to claim 13 wherein forcing a liquid target material through an orifice of a nozzle includes forcing a liquid target material through an orifice having a diameter of between 50–100 microns.

16. The method according to claim 13 wherein directing a pulse laser beam towards the target area includes directing a pulsed laser beam having a pulse rate between 5–10 kHz.

17. The method according to claim 13 wherein vibrating the nozzle includes vibrating the nozzle with a piezoelectric transducer.

18. The method according to claim 13 wherein the number of buffer droplets provided between successive target droplets is selected from the group consisting of one buffer droplet, two buffer droplets and three buffer droplets.

* * * * *